US009410679B2

(12) United States Patent
Hoetzl et al.

(10) Patent No.: US 9,410,679 B2
(45) Date of Patent: Aug. 9, 2016

(54) SECURING A SUPPORT AND COVERING A LIGHTING DEVICE

(75) Inventors: Guenter Hoetzl, Regensburg (DE); Peter Sachsenweger, Zeitlam (DE)

(73) Assignee: OSRAM GMBH, Munich (DE)

( * ) Notice: Subject to any disclaimer, the term of this patent is extended or adjusted under 35 U.S.C. 154(b) by 128 days.

(21) Appl. No.: 14/124,738

(22) PCT Filed: May 9, 2012

(86) PCT No.: PCT/EP2012/058541
§ 371 (c)(1),
(2), (4) Date: Feb. 20, 2014

(87) PCT Pub. No.: WO2012/168021
PCT Pub. Date: Dec. 13, 2012

(65) Prior Publication Data

US 2014/0192541 A1 Jul. 10, 2014

(30) Foreign Application Priority Data

Jun. 9, 2011 (DE) ..... 10 2011 077 323

(51) Int. Cl.

| | |
|---|---|
| ***F21V 21/00*** | (2006.01) |
| ***F21V 17/10*** | (2006.01) |
| ***F21K 99/00*** | (2016.01) |
| ***F21V 17/16*** | (2006.01) |
| *F21V 23/00* | (2015.01) |
| *F21Y 101/02* | (2006.01) |

(52) U.S. Cl.
CPC . *F21V 17/10* (2013.01); *F21K 9/30* (2013.01); *F21V 17/164* (2013.01); *F21V 23/005* (2013.01); *F21Y 2101/02* (2013.01); *Y10T 29/49002* (2015.01)

(58) Field of Classification Search
CPC ..... F21K 9/30; F21K 9/90; F21V 17/164; F21V 17/10; F21V 23/005
USPC ..... 362/374, 375
See application file for complete search history.

(56) References Cited

U.S. PATENT DOCUMENTS

| | | | | |
|---|---|---|---|---|
| 2010/0208474 | A1 | 8/2010 | Hancock et al. | |
| 2011/0157901 | A1* | 6/2011 | Chen | 362/373 |
| 2012/0206917 | A1* | 8/2012 | Burkard et al. | 362/249.01 |

FOREIGN PATENT DOCUMENTS

| | | | |
|---|---|---|---|
| CN | 200965183 | Y | 10/2007 |
| DE | 29715385 | U1 | 12/1997 |
| DE | 202004017718 | U1 | 3/2005 |
| DE | 202005001577 | U1 | 3/2005 |

(Continued)

OTHER PUBLICATIONS

German Office Action, dated Mar. 22, 2012.

(Continued)

*Primary Examiner* — Y M Lee
(74) *Attorney, Agent, or Firm* — Viering, Jentschura & Partner mbB

(57) ABSTRACT

A lighting device may include: a mount, which is populated with at least one electronic component and with at least one semiconductor light source, a cover for covering at least one electronic component and at least one connecting element for fastening the cover to the mount, wherein the connecting element is connected to the mount by means of a non-latching connection and to the cover by means of a latching connection.

11 Claims, 4 Drawing Sheets

(56) References Cited

FOREIGN PATENT DOCUMENTS

| | | | |
|---|---|---|---|
| DE | 202008017219 | U1 | 4/2009 |
| DE | 102008055936 | A1 | 5/2010 |
| DE | 202010013958 | U1 | 12/2010 |
| EP | 1983255 | A1 | 10/2008 |
| WO | 2011045336 | A1 | 4/2011 |

OTHER PUBLICATIONS

International Search Report for PCT/EP2012/058541, dated Aug. 3, 2012.

Chinese Office Action based on Application No. 201280023204.6 (9 Pages and 6 pages of English translation) dated Jul. 22, 2015 (Reference Purpose Only).

* cited by examiner

SECURING A SUPPORT AND COVERING A LIGHTING DEVICE

RELATED APPLICATIONS

This application is a national stage entry according to 35 U.S.C. §371 of PCT application No.: PCT/EP2012/058541 filed on May 9, 2012, which claims priority from German application No.: 10 2011 077 323.1 filed on Jun. 9, 2011.

TECHNICAL FIELD

Various embodiments relate to a lighting device, having a mount, which is populated with at least one electronic component and with at least one semiconductor light source, a cover for covering at least one electronic component and having at least one connecting element for fastening the cover to the mount. Particularly preferably, the disclosure can be used in lighting modules, in particular semiconductor lighting modules, in particular LED modules.

BACKGROUND

Lighting devices of the type mentioned at the outset are known in which the cover is fixedly adhesively bonded with its bearing rim to the mount. In this case, it is disadvantageous that this adhesive bonding requires a comparatively high degree of installation complexity and the lighting device needs to cure over a large area after the adhesive bonding. In addition, a comparatively large amount of adhesive is required.

Lighting devices of the type mentioned at the outset are also known in which the cover is clamped to the mount by means of separate clamps. However, these can become detached in the case of mechanical loading and are also comparatively expensive.

Lighting devices of the type mentioned at the outset are also known in which the cover is screwed to the mount by means of associated through-bolts. However, this can result in stresses in the cover and/or the mount.

SUMMARY

The present disclosure relate to improved fastening of a mount and a cover of a lighting device. The improvement can relate in particular to simplified fitting and good long-term stability of the lighting device.

Various embodiments provide a lighting device having a mount, which is populated with at least one electronic component and with at least one semiconductor light source, a cover for covering at least one electronic component and having at least one connecting element for fastening the cover to the mount, wherein the connecting element is connected to the mount by means of a non-latching connection and to the cover by means of a latching connection.

By virtue of this connecting element, secure fastening or connection between the mount and the cover which has long-term stability and is easy to use in terms of fitting technology is achieved. The cover can be positioned in a simple manner onto the mount (possibly via an intermediate element) and latched securely and permanently to the connecting element. By virtue of the provision of the non-latching connection to the mount, a connection with increased positional accuracy is provided which can fasten the connecting element to the mount in particular also in another manner than merely in a form-fitting manner.

The at least one electronic component may include, for example, a resistor, a capacitor, a coil and/or an integrated circuit, in particular with an SMD design. The at least one electronic component may be, for example, a driver circuit or part of a driver circuit for operating the at least one semiconductor light source.

Preferably, the at least one semiconductor light source includes at least one light-emitting diode. In the case where a plurality of light-emitting diodes are provided, said light-emitting diodes may illuminate in the same color or in different colors. A color can be monochrome (for example red, green, blue etc.) or multichrome (for example white). The light emitted by the at least one light-emitting diode may also be an infrared light (IR LED) or an ultraviolet light (UV LED). A plurality of light-emitting diodes may produce a mixed light, for example a white mixed light. The at least one light-emitting diode may contain at least one wavelength-modifying phosphor (conversion LED). The phosphor may alternatively or additionally be arranged remotely from the light-emitting diode ("remote phosphor"). The at least one light-emitting diode may be in the form of at least one individually housed light-emitting diode or in the form of at least one LED chip. A plurality of LED chips may be mounted on a common substrate ("submount"). The at least one light-emitting diode may be equipped with at least one dedicated and/or common optical element for beam guidance, for example at least one Fresnel lens, collimator or the like. Instead of or in addition to inorganic light-emitting diodes, for example based on InGaN or AlInGaP, organic LEDs (OLEDs, for example polymer OLEDs) can generally also be used. Alternatively, the at least one semiconductor light source may have at least one diode laser, for example.

The carrier may be in particular a printed circuit board or circuit board.

The cover may only cover the at least one electronic component or may also cover the at least one semiconductor light source (in light-transmissive fashion). The latching connection may be configured so as to be detachable or non-detachable.

The non-latching connection can in particular be a fixed connection in the sense that it enters into a permanent connection which is in particular non-detachable or is only detachable under considerable force expenditure which does not occur during normal mechanical loading.

A configuration consists in that the connecting element is inserted into an associated cutout in the mount. This enables fastening of the connecting element to the mount in a manner which is secure and simple in terms of fitting technology.

It is advantageous if the connecting element may be inserted into the mount from a side facing the cover. This enables simple fitting. It is also thus possible to avoid the connecting element from being capable of becoming detached from the side of the mount in order to prevent, for example, unwanted or unintentional detachment of the connection.

It is likewise expedient if the connecting element may be inserted into the cover from a side facing the mount. This enables simple fitting. It is thus also possible to avoid the connecting element being capable of becoming detached from the side of the cover in order to prevent, for example, unwanted or unintentional detachment of the connection. In particular when the connecting element can be inserted into the mount from a side facing the cover and into the cover from a side facing the mount, a connection is achieved which prevents unintentional or unwanted detachment particularly well.

A development consists in that the cutout in the mount is a passage through the mount, for example a bore. Thus, a secure fit of the connecting element in the cutout may be achieved, for example. In addition, the cutout can also be used as a passage for further elements, for example for passing through a bolt for fastening the finished lighting device, for example to a substrate.

A further configuration consists in that the connecting element is a press-fit/latching connecting element, which is held at least in a force-fitting manner in the associated cutout in the mount by means of a press-fit connection. The cutout is slightly narrower than that part of the press-fit/latching connecting element to be inserted into the cutout, in order to produce the press fit. By adjusting this misfit or this overdimension, the pressing force or force-fitting connection may be adjusted quantitatively easily. A length of the press-fit connection may be selected, for example, depending on a thickness of the mount and/or an overdimension of the press-fit connection. The press-fit connection is easily deformable so as to achieve a desired press fit. The press-fit connection can be severed in particular only with a considerable amount of mechanical effect.

An alternative configuration consists in that the connecting element is a screw/latching connecting element, which may be screwed into the associated cutout in the mount. For this purpose, the screw/latching connecting element can in particular have a screw thread. The screw thread can be in particular a self-tapping thread, for simple screwing to the mount.

An alternative or additional configuration consists in that the connecting element is an adhesive-bonding/latching connecting element, which may be adhesively bonded into the associated cutout in the mount. A further configuration consists in that the connecting element has at least one bearing face with which the connecting element hits the mount. Thus, a desired insertion depth of the connecting element during fitting thereof may be adjusted precisely by simple means.

Another configuration consists in that the connecting element has at least one latching projection, at which at least one associated latching hook of the cover latches in. Thus, the latching connection may be produced in a simple manner.

A development consists in that a recess of the latching projection which is in particular in a form-fitting engagement with the at least one associated latching hook is beveled on the outside in order to provide a detachable latching connection. A force which needs to be applied in order to detach the latching connection can be adjusted, for example, by fixing a setting angle and/or a setting geometry of the recess.

A development consists in that a recess of the latching projection which is in particular in a form-fitting engagement with the latching hook is beveled on the inside in order to provide a non-detachable latching connection. For this purpose, a latching tab of the latching hook, which latching tab protrudes laterally inwards, can in particular be curved.

Another configuration consists in that the connecting element has an outer contour with at least two steps in the axial direction, wherein a very narrow riser step is inserted into the associated cutout in the mount, a first, inner (tread) step acts as the bearing face, and a second, outer (tread) step acts as a recess of the latching projection. As a result, the functions of striking and latching are realized by means of a simply shaped and therefore inexpensively producible connecting element.

Yet a further configuration consists in that the connecting element has a cylindrical, in particular circular-cylindrical, basic shape. This configuration is particularly well suited for simply screwing in the screw/latching connecting element and for simply inserting the press-fit/latching connecting element by means of a rotary movement.

Another configuration consists in that the connecting element has a tubular basic shape. Thus, an interior can be used for receiving and/or passing through further elements, for example an electrical line or a further fastening element, in particular a screw, which facilitates installation of the lighting device.

Yet a further configuration consists in that the connecting element has, at its end inserted into the cutout in the mount, a bevel or chamfer tapering the end. Thus, radial finding between the connecting element and the cutout in the mount is facilitated.

Another configuration consists in that the cover has at least one cutout, into which the connecting element is or can be inserted. This enables in particular radial guidance of the cover during fitting. A gap can be provided between a rim of the cutout in the cover and the outer contour of the connecting element as tolerance compensation means and for compensating for different coefficients of linear thermal expansion in order to avoid mechanical stresses.

A development consists in that an upper rim of the connecting element adjoins the cover at least flush on the outside, i.e. adjoins it flush or protrudes out of the cutout in the cover. This upper rim can firstly act as a force introduction face during fitting of the connecting element and secondly be used for force transfer during installation of the finished lighting device, for example for a screw head of a screw for screwing the lighting device to a substrate. A force applied to the upper rim is transferred in the axial direction by the bearing face of the connecting element onto the mount. Thus, a force transfer through the cover is avoided, and the risk of remaining deformations or the formation of cracks, and in the case of a cover consisting of plastics, also plastic relaxation, is ruled out. Thus, a uniform thermal connection of the lighting device to a substrate can be ensured and, therefore, accelerated ageing of the semiconductor light sources can be avoided and a constant luminous flux over the life can be facilitated.

A further configuration consists in that the at least one latching hook emerges from a rim of the cutout. The at least one latching hook may in particular be directed inwards, i.e. be positioned on the inside, and therefore can be inaccessible from the outside. This enables a manipulation-safe, form-fitting latching connection. However, the at least one latching hook can also emanate from another region of the cover.

Yet a further configuration consists in that the mount has a first region, which is populated with at least one light source, and a second region which is populated with at least one electronic component, and the cover covers at least the second region (i.e. only the second region or the second and the first region). Thus, the light emitted by the at least one semiconductor light source is emitted by the lighting device with low losses.

A development consists in that the mount is circular, the first region is a central region and the second region is a region surrounding the central region in the form of a ring. Therefore, the cover also has a ring-shaped basic shape.

The connecting element can in particular be a metallic element. The cover can in particular be a plastics cover.

The lighting device can in principle be a lamp, a luminaire, a lighting module or a lighting system. Particularly preferred is a configuration as a lighting module, in particular an LED module. The lighting module can in particular not have a dedicated power supply, but can be connectable to a power supply, for example a transformer or a ballast, in particular when interconnected with further lighting modules.

Various embodiments also provide a connecting element which is configured for use with the lighting device as described above.

Such a connecting element has the same advantages as the lighting device and may be configured similarly to the connecting element described above.

Various embodiments also provide a method for fastening a cover to a mount of the lighting device as described above, wherein the method has at least the following steps: (a) inserting (for example plugging in and/or screwing in) the at least one connecting element into an associated cutout in the mount, and (b) positioning the cover onto the mount and latching in the cover on the at least one connecting element. Such a method has the same advantages as the lighting device and can have a similar configuration.

For example, the method can have at least the following steps: (a) pressing in the at least one press-fit/latching connecting element into an associated cutout in the mount, and (b) positioning the cover onto the mount and latching in the mount on the at least one press-fit/latching connecting element.

BRIEF DESCRIPTION OF THE DRAWINGS

In the drawings, like reference characters generally refer to the same parts throughout the different views. The drawings are not necessarily to scale, emphasis instead generally being replaced upon illustrating the principles of the disclosure. In the following description, various embodiments of the disclosure are described with reference to the following drawings, in which.

DETAILED DESCRIPTION

The following detailed description refers to the accompanying drawings that show, by way of illustration, specific details and embodiments in which the disclosure may be practiced.

Figure 1:
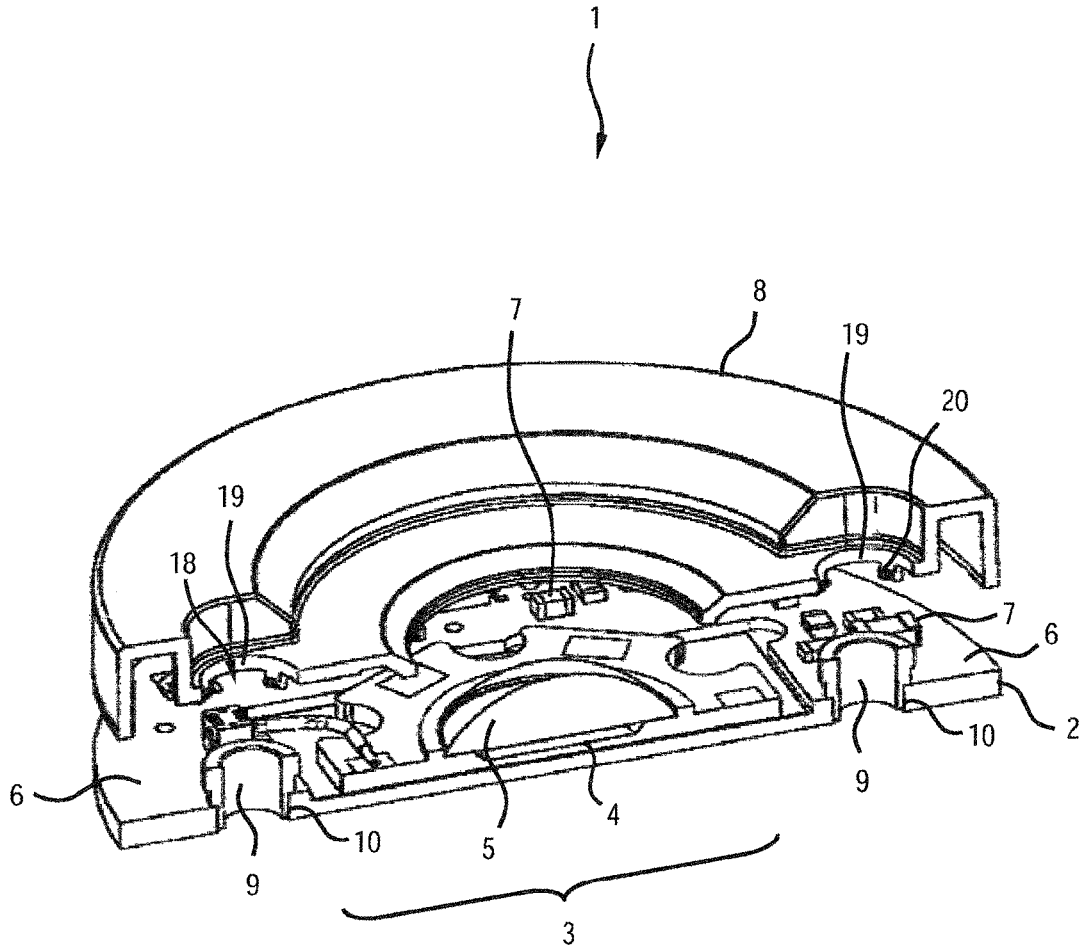
FIG. 1 shows a sectional illustration in a view at an angle from above of a lighting device according to the disclosure with a cover which is still separate from a mount.

FIG. 1 shows a sectional illustration in a view at an angle from above of a lighting device in the form of an LED module 1 with a printed circuit board 2 in the form of a circular disk acting as mount. A front side (which is shown) of the printed circuit board 2 is populated with at least one semiconductor light source in the form of one or more light-emitting diodes 4 in a first, central region 3. The at least one light-emitting diode 4 is covered by a common optical element in the form of a lens 5. The front side of the printed circuit board 2 is populated with a plurality of electronic components 7 in a second region 6 surrounding the central region 3 in the form of a ring.

The electronic components 7 are covered by means of a ring-shaped cover 8 consisting of non-light-transmissive plastics for the protection of said electronic components. The cover 8 rests on the printed circuit board 2 and is connected or fastened thereto by means of two metallic connecting elements 9.

The connecting elements 9 are each connected to the printed circuit board 2 by means of a non-latching connection and to the cover 8 by means of a latching connection.

Figure 2:
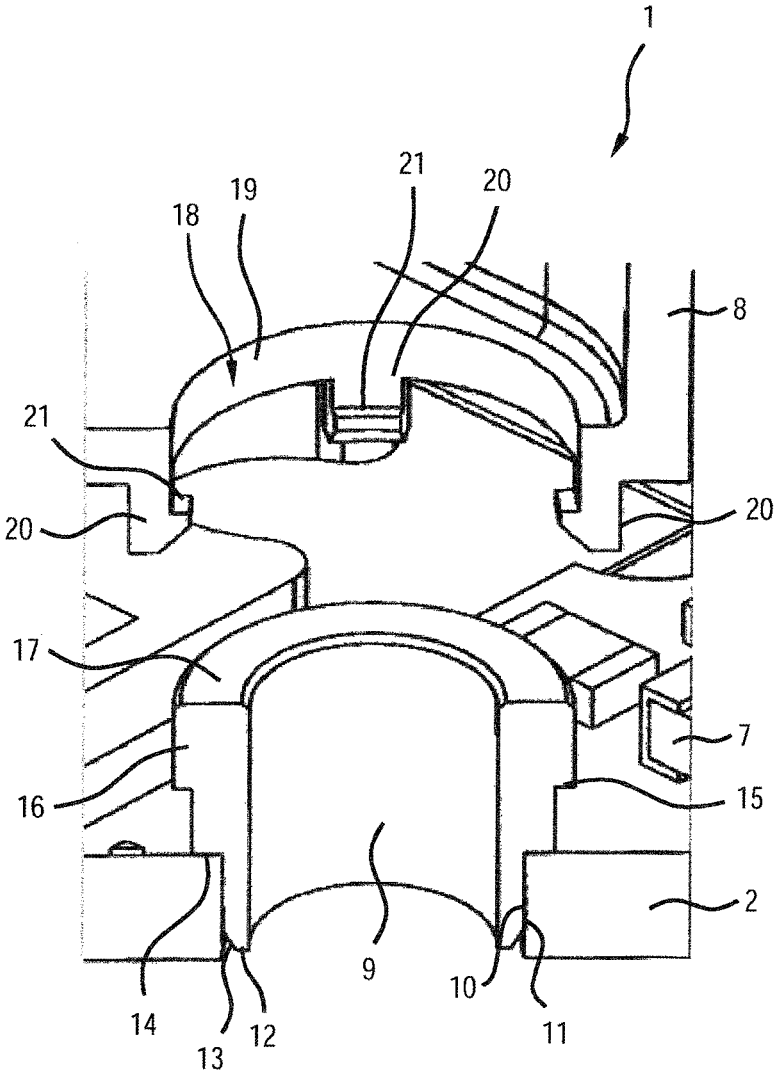
FIG. 2 shows a sectional illustration in a view at an angle from above of a detail of the still separate lighting device according to the disclosure in the region of a connecting element.

As is also shown in an enlarged illustration of a detail in FIG. 2, each of the connecting elements 9 has a hollow-cylindrical or tubular basic shape. The connecting element 9 has an outer contour with two steps in the axial direction. The stepped outer contour has a very narrow (perpendicular) riser step 10 (with the smallest outer diameter), which is inserted, from the front side of the printed circuit board 2, into an associated circular through-cutout 11 in the printed circuit board 2 in a force-fitting manner or with a press fit.

The press fit is achieved by virtue of the fact that a diameter of the cutout 11 is slightly smaller than the outer diameter of the riser step 10. The respective connecting element 9 therefore protrudes upwards in the direction of the cover 8 on a front side of the printed circuit board 2.

At its (lower) end 12 inserted into the cutout 11 in the printed circuit board 2, the connecting element 9 has a bevel 13 tapering the end 12. As a result, a radial finding between the connecting element 9 and the cutout 11 is facilitated.

A first, inner (horizontal) step 14, which adjoins the riser step 10, acts as a bearing face which strikes the printed circuit board 2 and enables a precise insertion depth of the connecting element 9 in the cutout 11.

A second, outer step 15 is located above the first step 14. The second step 15 has the greatest outer diameter and acts as a recess of a laterally peripheral latching projection 16 formed by the greatest outer diameter.

An upper, horizontal rim 17 of the connecting element 9 has a circular ring shape (which is slightly beveled on both sides). This upper rim 17 can act as a force introduction face during fitting of the connecting element 9.

The cover 8 has a circular cutout 18 above the connecting element 9, the rim 19 of said cutout having a diameter which is slightly greater than the (greatest) diameter of the latching projection 16. Thus, the connecting element 9 fits with a small gap or a small amount of play into the cutout 18, which is facilitated by the chamfering of the upper rim 17. By virtue of the play, tolerance compensation and compensation for different coefficients of linear thermal expansion are provided, in order to avoid mechanical stresses. Four latching hooks 20 which are arranged at equal distances on the rim 19 protrude from the rim of the cutout 18 perpendicularly downwards or in the direction of the printed circuit board 2. The tabs 21 of the latching hooks 20 point in the direction of the cutout 18 (inwards).

Figure 3:
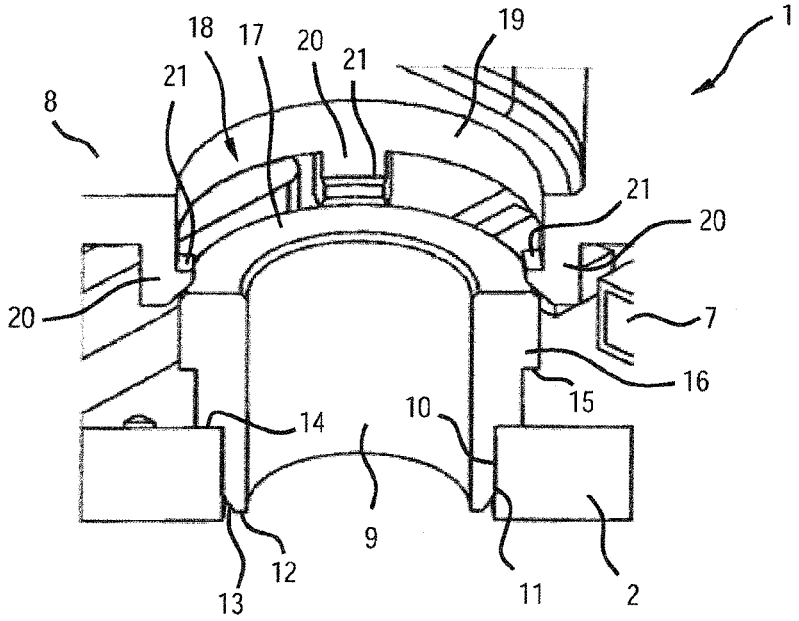
FIG. 3 shows an illustration similar to that in FIG. 2 with a cover which has now been positioned on the connecting element.

FIG. 3 shows an enlarged illustration of a detail of the LED module 1 in a state in which the cover 8 has now been lowered so far that it rests on the connecting element 9. The chamfering of the upper rim 17 of the connecting element 9, together with chamfering of the tabs 21 of the latching hooks 20, facilitates sliding and bending of the latching hooks 20 on the upper rim 17 with further lowering of the cover 8 onto the connecting elements 9.

Figure 4:
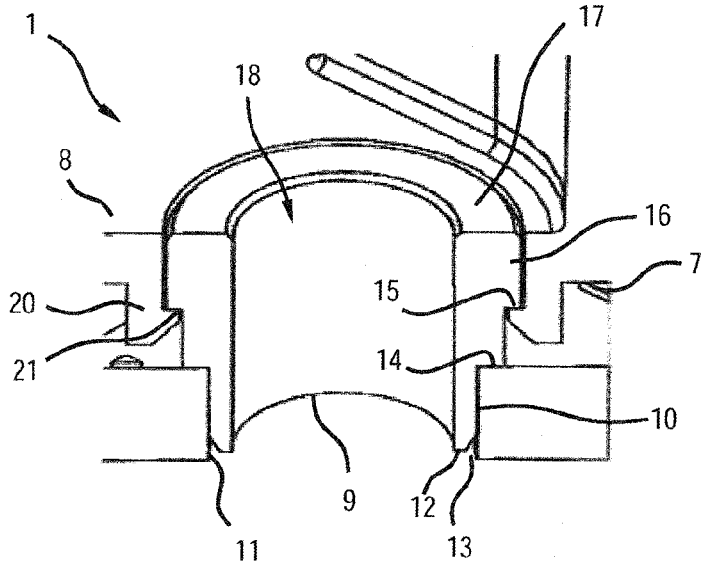
FIG. 4 shows an illustration similar to that in FIG. 2 and FIG. 3 with a cover which is now connected to the connecting element.
Figure 5:
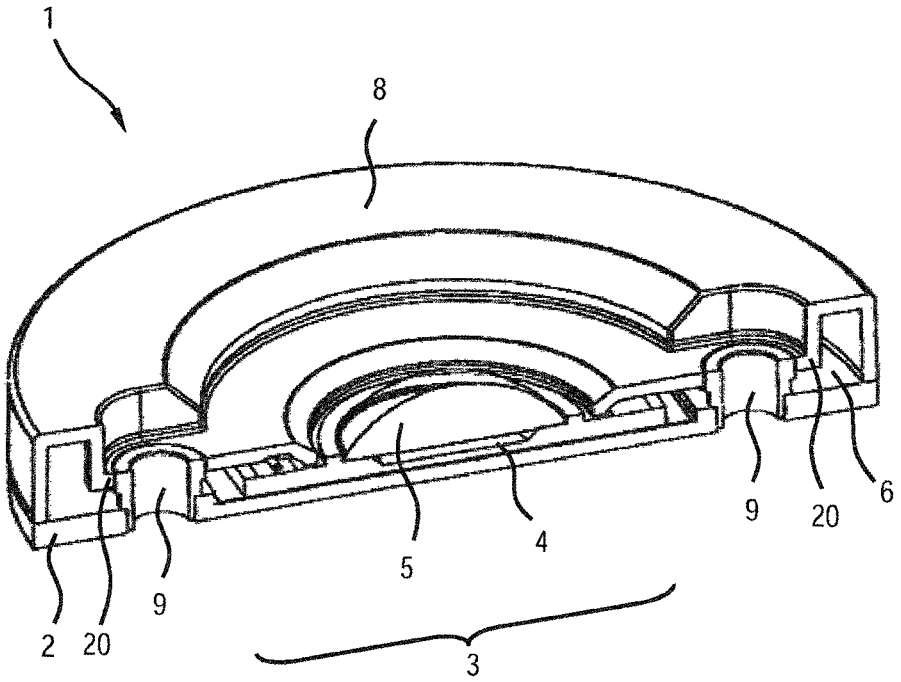
FIG. 5 shows an illustration similar to that in FIG. 1 of the lighting device according to the disclosure completely fitted.

FIG. 4 shows an enlarged illustration of a detail of the LED module 1 in a state in which the cover 8 is now completely latched with the connecting element 9 and therefore also with the printed circuit board 2. FIG. 5 shows, in section, the entire LED module 1 in this state.

The latching hooks 20 are now latched on the latching projection 16 of the associated connecting element 9 by virtue of the tabs 21 being in engagement with the second step 15 acting as recess. The second step 15 is in this case configured horizontally, with the result that the latching connection is non-detachable.

The cover 8 is lowered onto the printed circuit board 2 so far that the upper rim 17 of the connecting element 9 is substantially flush with the cover 8.

In order to fasten the LED module 1 on the rear side thereof (i.e. in this case via a rear side of the printed circuit board 2), said LED module can be screwed to a substrate etc. For this purpose, screws (not depicted) can be passed through the hollow connecting elements 9, wherein a screw head of these screws preferably rests on the upper rim 17 of the respective connecting element 9. A force applied by the screw head on the upper rim 17 is transferred in the axial direction through the riser step 10 acting as bearing face of the connecting element to the printed circuit board 2. Thus, a force transfer through the cover 8 is avoided. Such a screw connection can also be used for even more secure fastening and holding of the cover 8 on the printed circuit board 2.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

LIST OF REFERENCE SYMBOLS

1 LED module
2 Printed circuit board
3 Central region of printed circuit board
4 Light-emitting diode
5 Lens
6 Ring-shaped region of printed circuit board
7 Electronic component
8 Cover
9 Connecting element
10 Riser step
11 Cutout in printed circuit board
12 End of connecting element
13 Bevel
14 First step of connecting element
15 Second step of connecting element
16 Latching projection of connecting element
17 Upper rim of connecting element
18 Cutout in cover
19 Rim of cutout in cover
20 Latching hooks
21 Tab of latching hook

The invention claimed is:

1. A lighting device comprising
a mount, which is populated with at least one electronic component and with at least one semiconductor light source,
a cover for covering at least one electronic component and
at least one connecting element for fastening the cover to the mount,
wherein the connecting element is connected to the mount by means of a non-latching connection and to the cover by means of a latching connection,
wherein the connecting element is inserted into an associated cutout in the mount,
wherein the connecting element is an adhesive-bonding/latching connecting element, which can be adhesively bonded into the associated cutout in the mount.

2. The lighting device as claimed in claim 1, wherein the connecting element can be inserted into the mount from a side facing the cover.

3. The lighting device as claimed in claim 1, wherein the connecting element can be inserted into the cover from a side facing the mount.

4. The lighting device as claimed in claim 1, wherein the connecting element has at least one bearing face with which the connecting element hits the mount.

5. The lighting device as claimed in claim 1, wherein the connecting element has at least one latching projection, at which at least one associated latching hook of the cover latches in.

6. The lighting device as claimed in claim 4,
wherein the connecting element has an outer contour with at least two steps,
wherein
a very narrow riser step is inserted into the associated cutout in the mount,
a first, inner step acts as the bearing face, and
a second, outer step acts as a recess of the latching projection.

7. The lighting device as claimed in claim 1, wherein the connecting element has a cylindrical basic shape.

8. The lighting device as claimed in claim 1, wherein the connecting element has a tubular basic shape.

9. The lighting device as claimed in claim 1, wherein the connecting element has, at its end inserted into the cutout in the mount, a bevel tapering the end.

10. The lighting device as claimed in claim 1, wherein the cover has at least one cutout, into which the connecting element is inserted with a matching fit, wherein, starting from a rim of the cutout, the at least one latching hook is directed inwards.

11. The lighting device as claimed in claim 1, wherein the mount has a first region, which is populated with the at least one light source, and a second region which is populated with the at least one electronic component, and wherein the cover covers at least the second region.

* * * * *